US006123607A

United States Patent [19]

Ravkin et al.

[11] Patent Number: 6,123,607

[45] **Date of Patent: *Sep. 26, 2000**

[54] METHOD AND APPARATUS FOR IMPROVED CONDITIONING OF POLISHING PADS

[76] Inventors: Michael A. Ravkin, 1215 Knickerbocker Dr., Sunnyvale, Calif. 94086; Ilya A. Ravkin, 945 Colorado Ave., Palo Alto, Calif. 94303; Yuli Verhovsky, 3937 Brookline Way, Redwood City, Calif. 94059

[ * ] Notice: This patent is subject to a terminal disclaimer.

[21] Appl. No.: 09/313,218

[22] Filed: May 17, 1999

Related U.S. Application Data

[63] Continuation-in-part of application No. 09/003,904, Jan. 7, 1998, Pat. No. 5,941,762.

[51] Int. Cl.[7] ..... B24B 1/00

[52] U.S. Cl. ..... 451/56; 451/43; 451/444; 451/72

[58] Field of Search ..... 451/56, 443, 444, 451/72

[56] References Cited

U.S. PATENT DOCUMENTS

| | | | |
|---|---|---|---|
| 5,154,021 | 10/1992 | Bombardier et al. . | |
| 5,486,131 | 1/1996 | Cesna et al. | 451/56 |
| 5,547,417 | 8/1996 | Breivogel et al. . | |
| 5,611,943 | 3/1997 | Cadien et al. . | |
| 5,833,519 | 11/1998 | Moore | 451/56 |

*Primary Examiner*—David A. Scherbel
*Assistant Examiner*—Shantese McDonald
*Attorney, Agent, or Firm*—Blakely, Sokoloff, Taylor & Zafman LLP

[57] ABSTRACT

A method and apparatus for conditioning the surface of a polishing pad used to polish a substrate, such as a semiconductor wafer. A conditioning apparatus uses two or more end effectors to abrade and/or remove the polishing byproducts from the surface of the pad. Different types of conditioning performance can be achieved when the end effectors are employed individually, sequentially, or simultaneously during a polishing process.

25 Claims, 12 Drawing Sheets

METHOD AND APPARATUS FOR IMPROVED CONDITIONING OF POLISHING PADS

RELATED APPLICATIONS

This application is a continuation-in-part application of the United States patent application entitled "Method and Apparatus for Improved Conditioning of Polishing Pads," Ser. No. 09/003,904, filed Jan. 7, 1998, and now issued as U.S. Pat. No. 5,941,762. That application is incorporated herein by reference.

BACKGROUND OF THE INVENTION

1. Field of the Invention

This invention relates generally to the field of semiconductor processing technology. More specifically, this invention relates to the conditioning and cleaning of polishing pads used in the substrate polishing and planarization process of semiconductor manufacturing.

2. Description of the Related Art

During the manufacturing process of an integrated circuit, a semiconductor wafer is often polished to remove unwanted materials on the surface of the wafer. The polishing or planarization process can also remove a layer or a partial layer comprised of a material (usually of thin film), such as dielectric, metal, or polysilicon, deposited on the surface of a semiconductor wafer in order to form the necessary interconnects, insulation, and various components of the integrated circuit.

One such process involves polishing the substrate on a polishing pad. One polishing process is commonly referred to as Chemical-Mechanical Polishing (CMP). In a typical arrangement, a substrate is supported by a carrier which presses the substrate against the surface of a moving polishing pad. The polishing process may take place in the presence of a polishing slurry, water (with or without some amount of suitable chemical), or without any such agent. However, with CMP a polishing slurry is generally utilized. The polishing process continues in this manner until the desired surface of the substrate is planarized or in some cases completely removed.

During the polishing process, the properties of the polishing pad can change. Slurry particles and polishing byproducts accumulate on the surface of the pad. Polishing byproducts and morphology changes on the pad surface affect the properties of the polishing pad and cause the polishing pad to suffer from a reduction in both its polishing rate and performance uniformity. Pad conditioning restores the polishing pad's properties by re-abrading or otherwise restoring the surface of the polishing pad. This conditioning process enables the pad to maintain a stable removal rate while polishing a substrate or planarizing a deposited layer and lessens the impact of pad degradation on the quality of the polished substrate.

During the conditioning process, a conditioner (also referred to as an end effector) used to recondition the polishing pad's surface comes into contact with the pad and re-abrades the pad's surface. The type of conditioner used depends on the pad type. For example, hard polishing pads, typically constructed of synthetic polymers such as polyurethane, require the conditioner to be made of a very hard material, such as diamond, serrated steel, or ceramic bits, to recondition the pad. Intermediate polishing pads with extended fibers require a softer material, often a brush with stiff bristles, to recondition the pad. Meanwhile, soft polishing pads, such as those made of felt, are best conditioned by a soft bristle brush or a pressurized spray.

Pad conditioning devices known in the prior art employ a single conditioner, conditioning means, or end effector brought into contact with the polishing pad. Generally, the selected conditioner is designed to recondition a specific type of pad surface. For example, U.S. Pat. No. 5,154,021 raises flattened pad fibers with a downward directed stream of air. This method works best on intermediate pad surfaces with longer pad fibers, but is not as successful on harder pad surfaces such as polyurethane. On the other hand, U.S. Pat. Nos. 5,486,131 and 5,547,417 recondition the pad surface using cutting means and a grooved block fitted with diamond tips, respectively. These methods are well suited for harder polishing pads like polyurethane, but would be too rough for a more intermediate pad surface. Thus, every time the type of polishing pad on the polishing machine changes, the conditioning mechanism must also be replaced with a conditioner having properties necessary to condition the new type of pad. This requires the polishing machine user to maintain several different types of conditioning devices, one for each different type of polishing pad used. Also, time is required to change the conditioner.

Similarly, the prior art does not allow for complex conditioning of a polishing pad. Complex conditioning involves a more controlled and varied conditioning than is currently possible. For example, the polishing pad of an orbital polishing machine often becomes more worn along the track the wafer follows during polishing. Conditioning of the wafer track may require reabrasion of the pad surface with a diamond cutting means followed by brushing off the pad surface with a soft bristle. In contrast, the area outside the wafer track often merely needs to be brushed with a soft bristle or rinsed. This type of varied conditioning treatment is not possible when only one conditioning means is available for use with each polishing apparatus.

In addition to only being able to condition a single type of pad, the prior art conditioners are utilized to re-abrade the polishing pad. A conditioner having an independent means for cleaning the re-abraded pad would be desirable. It would also be advantageous to simultaneously or sequentially re-abrade and clean the pad without stopping the polishing process to change the conditioning medium.

SUMMARY OF THE INVENTION

The present invention is a method and apparatus for conditioning the surface of a polishing pad. The present invention comprises a conditioning device which includes at least two conditioners, wherein the conditioners have different conditioning materials and conditioning properties. One embodiment of the present invention comprises two conditioners coupled to a conditioning arm. The first conditioner utilizes a hard material (such as diamond, serrated steel, or ceramic bits) and the second conditioner utilizes a soft material (such as synthetic fibers of nylon or polypropylene). Each conditioner is adapted for movement to bring it into contact with the surface of the polishing pad. The conditioners may engage the pad simultaneously or independently of one another. During the polishing process, the conditioners can be made to react in a variety of ways to engage the pad. For example, the force applied by each conditioner to the polishing pad can be varied both with time and with respect to the amount of force applied by other conditioners. Also, during the conditioning process, each conditioner can be made adjustable to move in a linear movement along the conditioning arm and/or rotate about a vertical axis normal to the polishing pad.

DESCRIPTION OF THE DRAWINGS

The invention is further described by way of example with reference to the accompanying drawings, wherein.

DETAILED DESCRIPTION OF THE INVENTION

This disclosure describes a method and apparatus for conditioning a surface of a polishing pad used to polish substrates and/or materials deposited on a substrate, such as a semiconductor wafer or a substrate used in the manufacturing of flat panel displays. The following description sets out numerous specific details, such as specific structures, materials, polishing techniques, etc. to provide a thorough understanding of the present invention. However, one skilled in the art will appreciate that the present invention can be practiced without these specific details. In other instances, this description does not describe well know techniques and structures in detail in order not to obscure the present invention. Although this disclosure describes the present invention in reference to conditioning pads used to polish semiconductor wafers, the present invention is readily adaptable to condition pads used to polish other materials such as glass or substrates for the manufacture of flat panel displays.

A polishing machine is used in semiconductor manufacturing to planarize various layers (such as thin films) formed on a substrate (such as a silicon wafer). During polishing, the face of the wafer is disposed to engage the polishing pad. Typically, the wafer is supported by a carrier which applies a downward force to press the wafer face downward onto the pad. A polishing slurry is typically present to perform Chemical-Mechanical Polishing (CMP). As the polishing pad moves relatively across the surface of the wafer, the mechanical abrasive motion in the presence of the slurry polishes away a selected material on the surface of the wafer. The material removed can be the substrate material of the wafer itself or one of the layers formed on the wafer. The formed layer may include dielectric materials, metals, metal alloys or semiconductor materials.

Figure 1A:
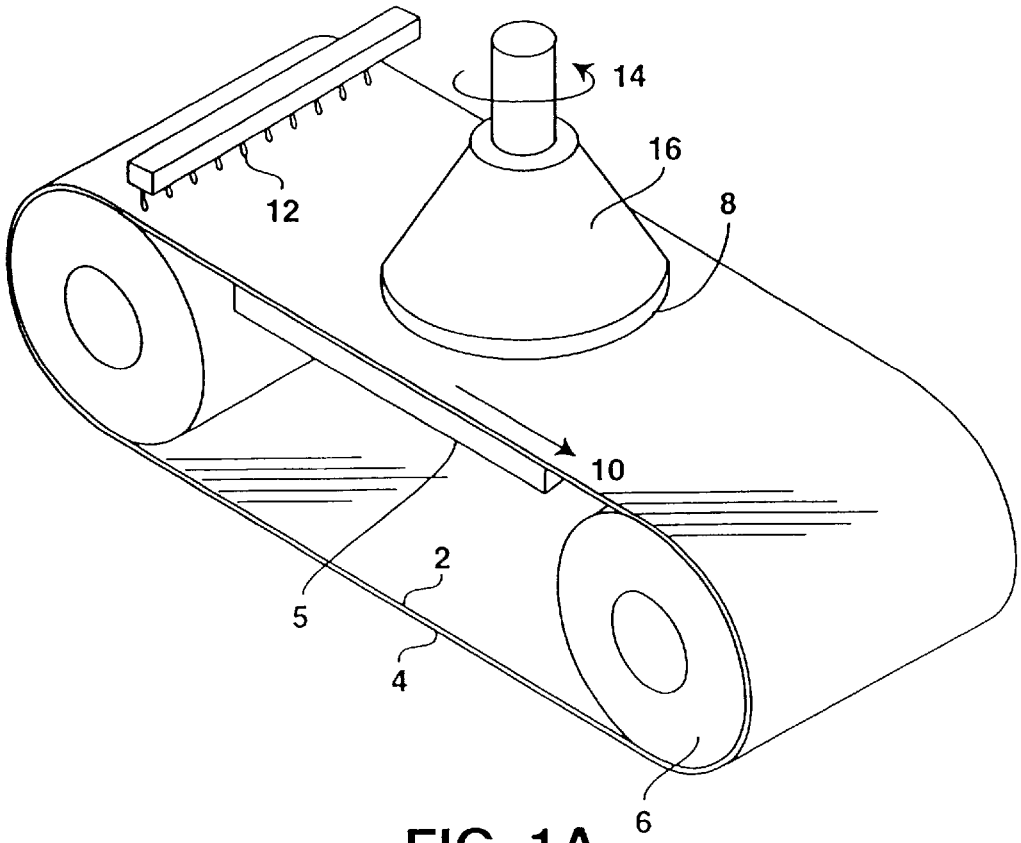
FIG. 1A illustrates a linear polishing tool known in the prior art.

FIG. 1A shows a linear polishing tool used for performing CMP. The linear polishing tool uses a continuous belt 2 with a polishing pad 4 attached to the outer surface of the belt 2. The belt 2 and the attached polishing pad 4 rotate about rollers 6 to move linearly with respect to the surface of the wafer 8 as shown by arrow 10. A platen 5 provides support for the pad and belt combination as the carrier 16 presses the wafer 8 onto the pad 4 during the polishing process. A polishing slurry 12 is dispersed from a slurry dispenser. Additionally, the carrier 16 can rotate (as shown by arrow 14) to further facilitate the polishing process.

Figure 1B:
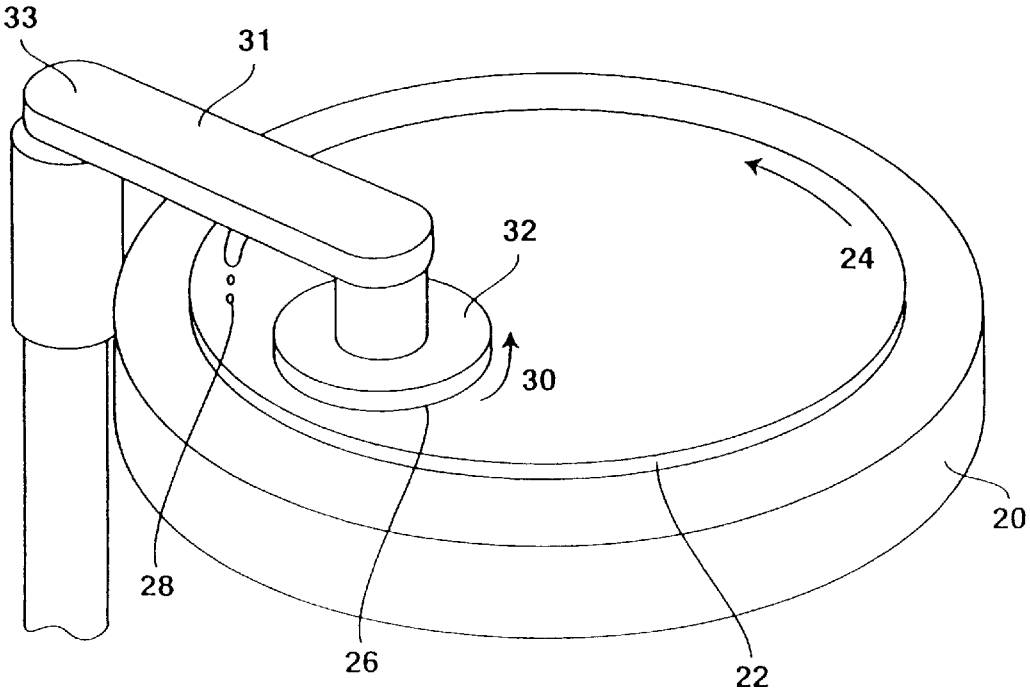
FIG. 1B illustrates an orbital polishing tool known in the prior art.

FIG. 1B shows an orbital polishing tool also used for performing CMP. The orbital polishing tool uses a circular platen 20 with a polishing pad 22 disposed on the platen's upper surface. The platen 20 and the polishing pad 22 rotate about a circular axis (as shown by arrow 24) to move angularly with respect to the surface of the wafer 26. As with the linear polishing machine, a slurry 28 is dispensed onto the pad 22. The carrier 32 can rotate (as shown by arrow 30) independently of the pad's rotation 24. The arm 31 may also rotate about axis 33 to move the carrier 32 and attached wafer 26 across the surface of the polishing pad 22.

During the operation of either type of polishing assembly, the properties of the polishing pad change. The polishing pad often becomes worn and unevenly compressed. Additionally, slurry particles and polishing byproducts accumulate on the surface of the pad and become imbedded in the pad surface. The polishing byproducts affect the roughness of the polishing pad and cause the polishing pad to suffer from a reduction in both its polishing rate and performance uniformity. However, pad conditioning restores the polishing pad's properties by re-abrading and/or cleaning the surface of the polishing pad. This conditioning process (also referred to as reconditioning) enables the pad to continue polishing a wafer and lessens the impact of pad degradation on the quality of the polished wafer.

As previously described in the Background section, a number of disadvantages are noted with the use of prior art conditioners employing a single conditioning element or means. The present invention conditions (or reconditions) the polishing pad using more than one conditioning material. A conditioner having two parts, each part being comprised of a separate conditioning material, is brought into contact with the polishing pad. In the preferred embodiment, two or more conditioners (also referred to as end effectors) are used to recondition the surface of the polishing pad. The movement of the polishing pad against the surface of the conditioner re-abrades the surface of the polishing pad and/or removes any polishing byproducts or waste from the surface of the polishing pad. Since the conditioning materials of the conditioner are different, the pad conditioning characteristics will also differ, depending on which conditioning material (or medium) is engaging the pad.

Figure 2A:
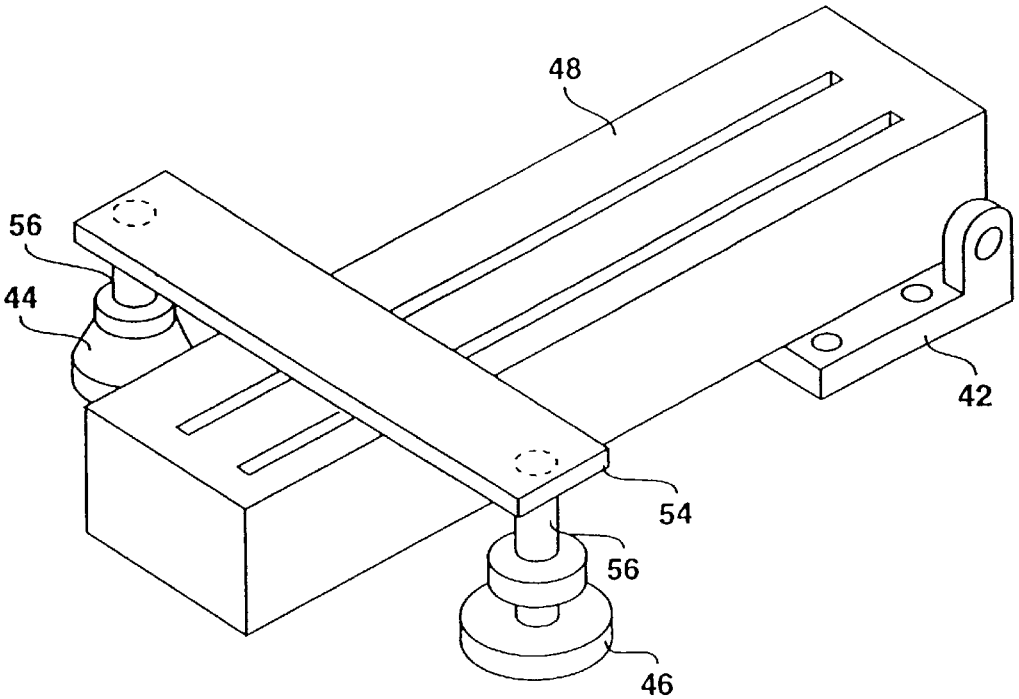
FIG. 2A illustrates an embodiment of a conditioning device of the present invention in which the device is generally utilized with a linear polishing tool, such as the one shown in FIG. 1A.
Figure 2B:
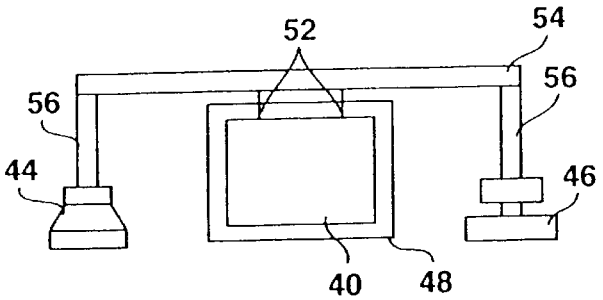
FIG. 2B illustrates a side view of the conditioning device of FIG. 2A.

FIGS. 2A and 2B illustrate a first embodiment of a conditioning device of the present invention for use with a linear polishing tool, such as the one shown in FIG. 1A. The conditioning apparatus comprises at least two end effectors 44 and 46 coupled to a support arm (also referred to as a conditioning arm) 40, with the conditioning arm 40 cantilevered to a base 42. The conditioning arm 40 is surrounded by a mechanism cover 48 to minimize exposure of the conditioning arm 40 to the polishing byproducts. The mechanism cover 48 has tracks 50 through which support members 52 attach to the conditioning arm 40 at one end and mechanically couple to a support bracket 54 at an opposite end. End effectors 44 and 46 couple to the support bracket 54 by arms 56.

Figure 2C:
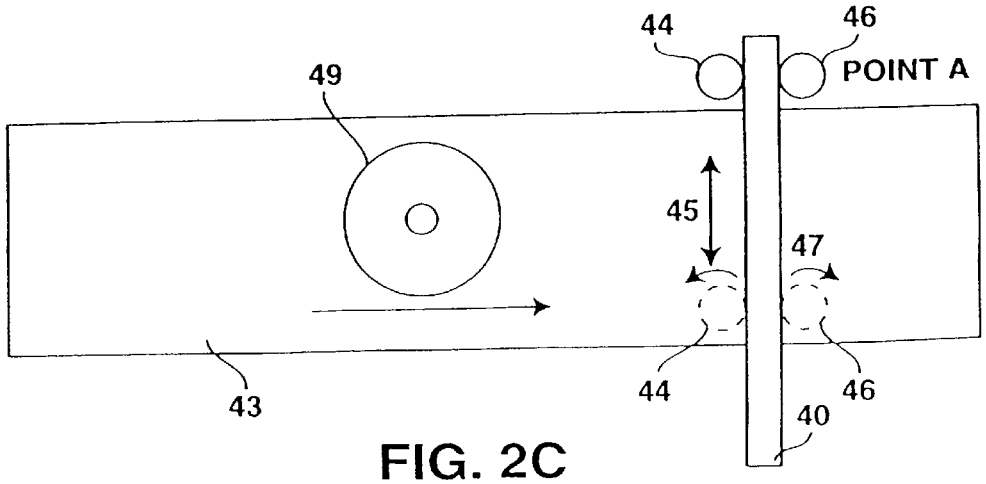
FIG. 2C illustrates a top view of the conditioning device of FIG. 2A as used with a linear polishing tool.

Although more than two end effectors can be used, the first embodiment uses two end effectors 44 and 46. End effector 44 has a hard element, such as diamond bits, serrated steel bits, ceramic bits, or stiff synthetic fibers attached to its bottom surface. A typical hard end effector has nickel plated diamond particles with grit in the range of approximately 80 to 120 mesh, U.S. Sieve Series. A softer element, such as synthetic fibers of nylon or polypropylene, is attached to the bottom surface of end effector 46. The size of the different types of particles attached to each end effector may be varied, depending on the degree of pad conditioning required. The larger the size of the particle, the deeper and more aggressive is the re-abrasion action (given the same engagement force). The exact shape or material of the end effectors themselves is not critical to the practice of the invention. However, in the first embodiment, the end effectors are round and generally vary from one to six inches in diameter. The actual size of the end effectors is a design choice dictated primarily by the size of the tool and the size of the wafer being polished FIG. 2C shows a top view of the first embodiment of the conditioning device of the present invention as used with a linear polishing tool. The pad conditioning apparatus, comprising the conditioning arm 40 and end effectors 44 and 46, is positioned in a spaced relationship across the linear polishing pad 43. Typically, it is desirable to locate the conditioning arm 40 so as to engage the end effectors 44 and 46 onto the pad 43 after the pad has passed by the wafer 49. That is, as the pad travels linearly, the pad engages the wafer first and then engages the conditioners.

The conditioning arm 40 is generally stationary when used with a linear polishing tool, but can be designed to allow repositioning of the conditioning arm 40 to a desired height and/or linear position relative to the polishing pad. The end effectors 44 and 46 begin at a home position (point A) and move linearly (in direction 45) along the conditioning arm 40 and across the surface of the polishing pad 43. Although the movement may be achieved manually, it is preferable that the movement of the end effectors be mechanically driven. For example, end effectors 44 and 46 may be coupled to a motor, a linear pneumatic actuator, a lead screw device, or other such means to allow linear movement along the conditioning arm 40 by the end effectors. However, if the end effector was wider than the wafer 49, linear movement of the end effector along the conditioning arm 40 would not be necessary to maintain a uniform reconditioning of the polishing pad along the wafer track. Similarly, rotation 47 of the end effectors about a vertical axis normal to the surface of the polishing pad 43 may be used to further facilitate the reconditioning of the polishing pad 43. The rotating shaft of the end effector may be driven by a motor, rotary pneumatic actuator, or other such means.

Figure 3A:
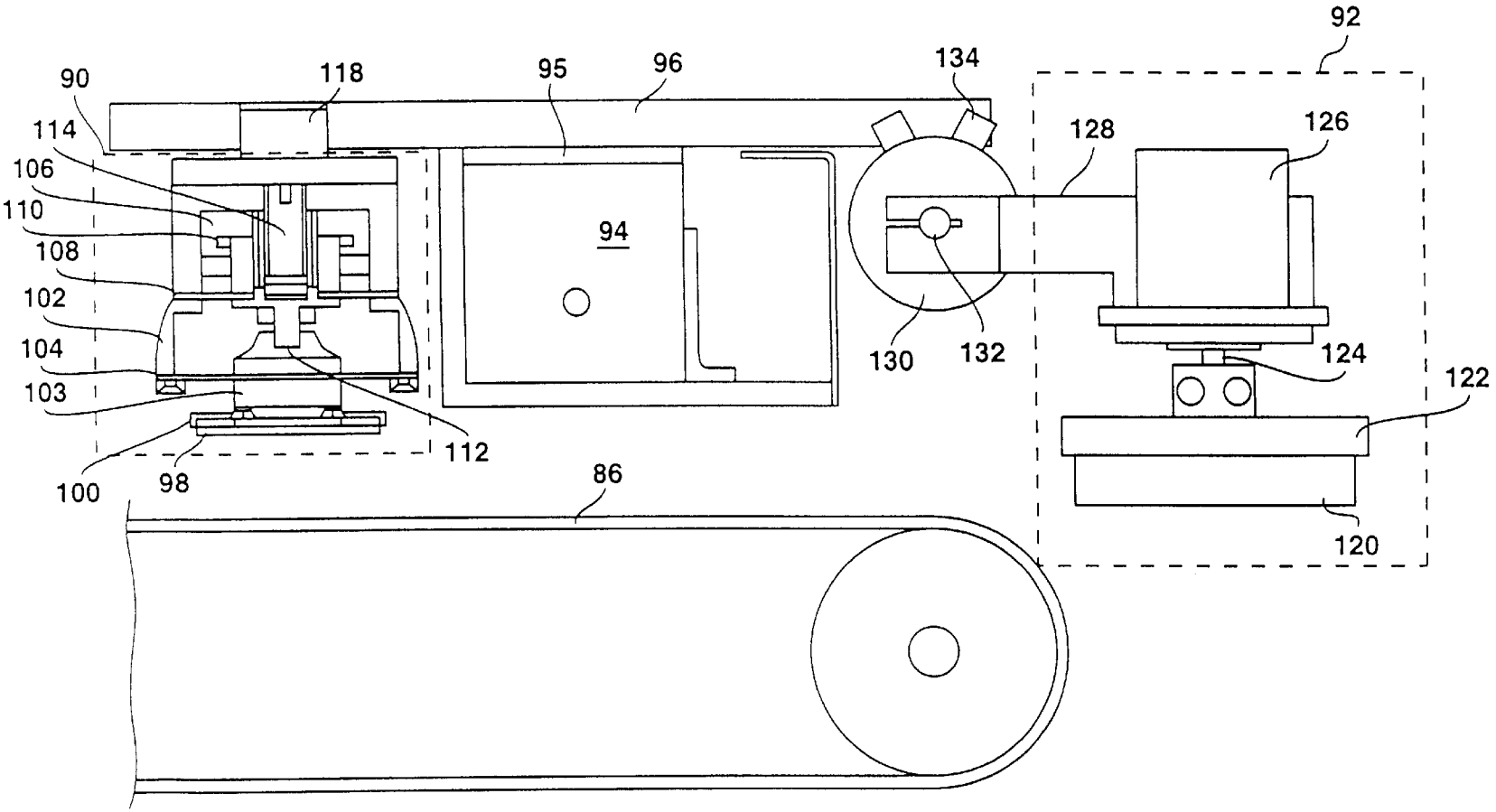
FIG. 3A illustrates a side view of a second embodiment of a conditioning device of the present invention in which the device is generally utilized with a linear polishing tool.
Figure 3B:
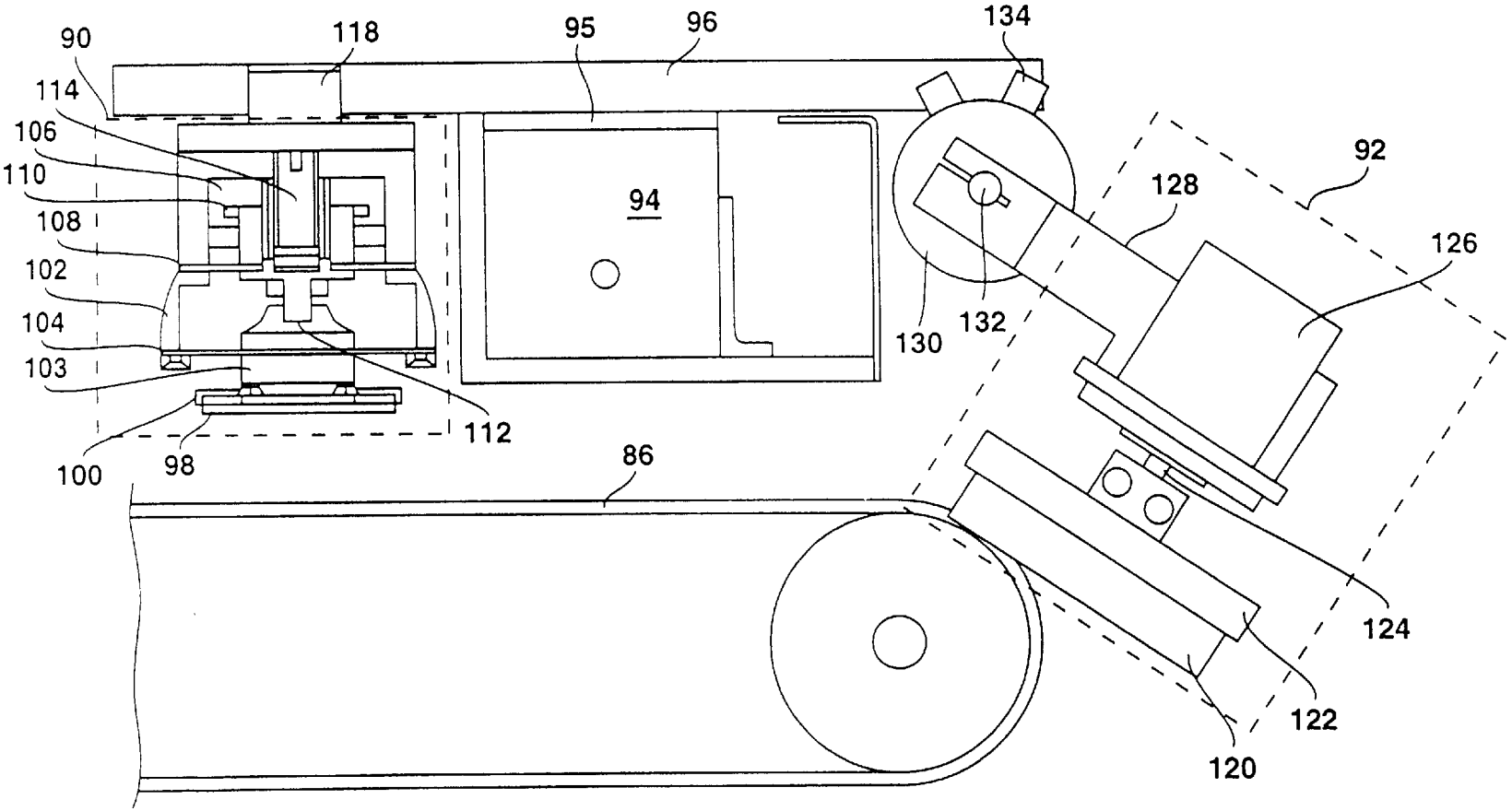
FIG. 3B illustrates the position of the conditioning device of FIG. 3A during the conditioning process.

FIGS. 3A and 3B illustrate a second embodiment of a conditioning device of the present invention for use with a linear polishing tool, such as the one shown in FIG. 1A. As with the first embodiment, two end effectors 90 and 92 (one with a hard element and the other with a softer element) couple to a conditioning arm 94.

End effector 90 is used for abrasive conditioning. The face 98 of end effector 90 comprises hard particles, such as diamond particles, and fits inside a magnetic holder 100. The holder 100 couples to a diaphragm 104 by a connecting piece 103. The diaphragm 104 attaches to the outer housing 102 of the end effector 90 and isolates the inside of end effector 90 from slurry and polishing byproducts. Space 106 is sealed by a diaphragm 108. Compressed air is released into space 106 by a regulator and valve to create a downward force and bring the face 98 of end effector 90 into contact with the polishing pad 86. The downward movement is limited by fins 110. A ball-and-socket 112 allows a gimballing motion to occur in response to the lateral forces created by the linear motion of the polishing pad across the face 98 of end effector 90. A central shaft 114 limits the amount of gimballing that can occur. By allowing the face 98 of end effector 90 to gimbal in response to the lateral forces, the abrasive conditioning of the polishing pad 86 will occur more uniformly.

The second end effector 92 is used to remove the slurry and polishing byproducts loosened by the abrasive property of the first end effector 90. A brush component of the end effector 92 is comprised of synthetic fibers 120 held by base 122. Base 122 couples to motor shaft 124 of the motor within housing 126. This motor controls the rotation of the brush when the brush is in contact with the polishing pad 86. An arm 128 couples the motor housing 126 to a rotating shaft 132 of a rotary pneumatic actuator within housing 130. The actuator causes the end effector 92 to pivot about rotating shaft 132 until the fibers 120 of the brush come into contact with the polishing pad 86. FIG. 3A shows the position of end effector 92 when not in use, and FIG. 3B shows the position of end effector 92 during the conditioning process.

Both end effectors 90 and 92 are coupled to a support bracket 96 which is coupled to a conditioning arm 94. End effector 92 is coupled to the support bracket 96 by brace 134. A small shaft 118 couples end effector 90 to support bracket 96. The shaft 118 has screws to adjust the height of end effector 90 with respect to the polishing pad 86. The support bracket 96 attaches to slide 95. Slide 95 is then coupled to the conditioning arm 94 which contains a linear sliding mechanism, such as a lead screw or one of the earlier mentioned devices, by which slide 95 is moved. In this manner, end effectors 90 and 92 are moved linearly along the conditioning arm 94 (in the same manner as direction 45 in FIG. 2C) and thus across the surface of the polishing pad 86.

Figure 4A:
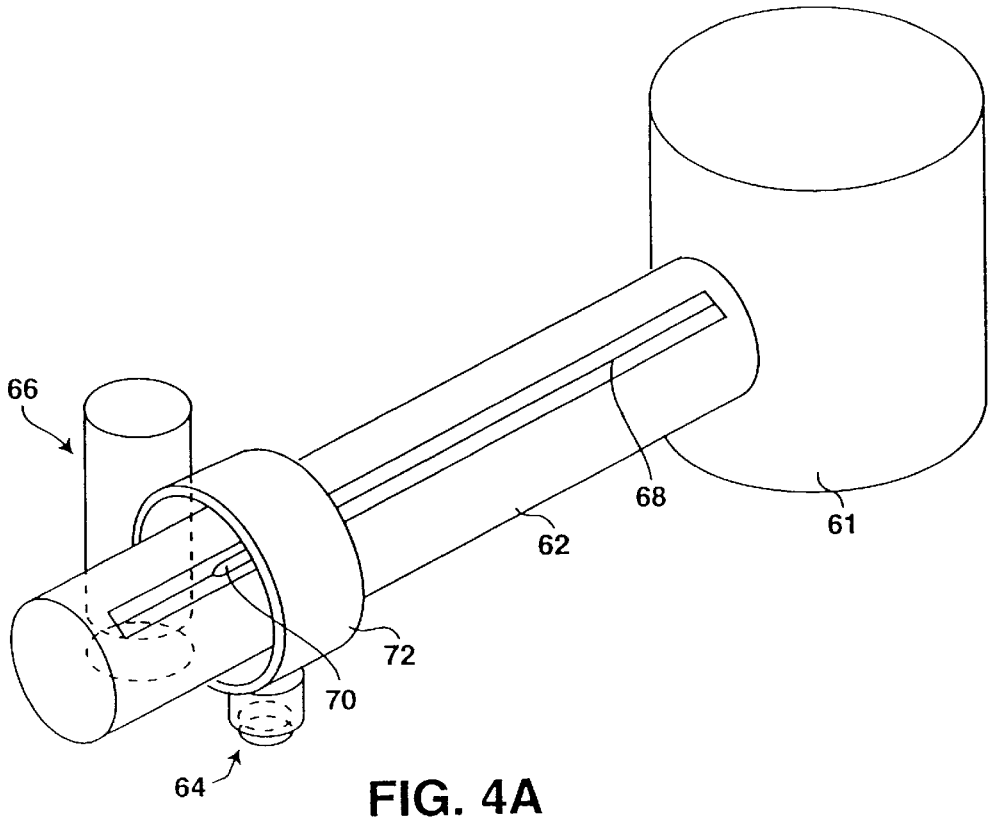
FIG. 4A illustrates an embodiment of a conditioning device of the present invention in which the device is generally utilized with an orbital polishing tool, such as the one shown in FIG. 1B.

In an equivalent manner to that described above for use with a linear polishing tool, the conditioning device of the present invention may also be used to condition the polishing pad of an orbital polishing tool. FIGS. 4A and 4B illustrate a third embodiment of a conditioning apparatus of the present invention for use with an orbital polishing tool, such as the one shown in FIG. 1B. As with the device used with the linear polishing machine, this conditioning device also comprises two end effectors 64 and 66 that are coupled to a conditioning arm 60. The conditioning arm 60, coupled to a base 61 around which it may pivot, is surrounded by a mechanism cover 62 that minimizes exposure of the conditioning arm 60 to the polishing byproducts. The mechanism cover 62 has tracks 68 through which support members 70 attach to the conditioning arm 60 at one end and couple to a support ring 72 at the opposite end. Mounting blocks 74 are attached to the support ring 72. Each end effector 64 and 66 couples to a mounting block 74.

End effector 64 is used for abrasive conditioning and is similar to end effector 90 (see FIG. 3A) described in the second embodiment. The face 65 of end effector 64 comprises diamond particles and is held in place by a magnetic holder 67. The holder 67 is coupled with a diaphragm 69 that isolates the inside of end effector 64 from slurry and polishing byproducts. A second diaphragm 71 seals space 73. Compressed air is released into space 73 by an automatic regulator and valve to create a downward force and bring the face 65 into contact with the polishing pad. A ball-and-socket 75 allows a gimballing motion to occur in response to the lateral forces created by the linear motion of the polishing pad across the face 65 of end effector 64. A central shaft 77 limits the amount of gimballing that can occur. By allowing the face 65 of end effector 64 to gimbal in response to the lateral forces, the abrasive conditioning of the polishing pad will occur more uniformly.

End effector 66 is used to remove the slurry and polishing byproducts loosened by abrasive end effector 90. A brush comprising synthetic fibers 78 is held by base 79. A connecting piece 80 attaches the base 79 of the brush to the frame 81. An air cylinder 82 provides a downward force by extending shaft 83 against frame 81 to lower the brush into contact with the polishing pad. The couplings with ball bearings 84 allow the brush to gimbal slightly to adjust for any lateral forces created by the polishing pad against the fibers 78 during the conditioning process. However, the space 86 between the frame 81 and the base 79 limits any gimballing motion. A motor shaft 87 of the motor 86 couples to the central shaft 88 of the end effector and controls rotation of the brush once the brush is lowered and in contact with the polishing pad.

Figure 4C:
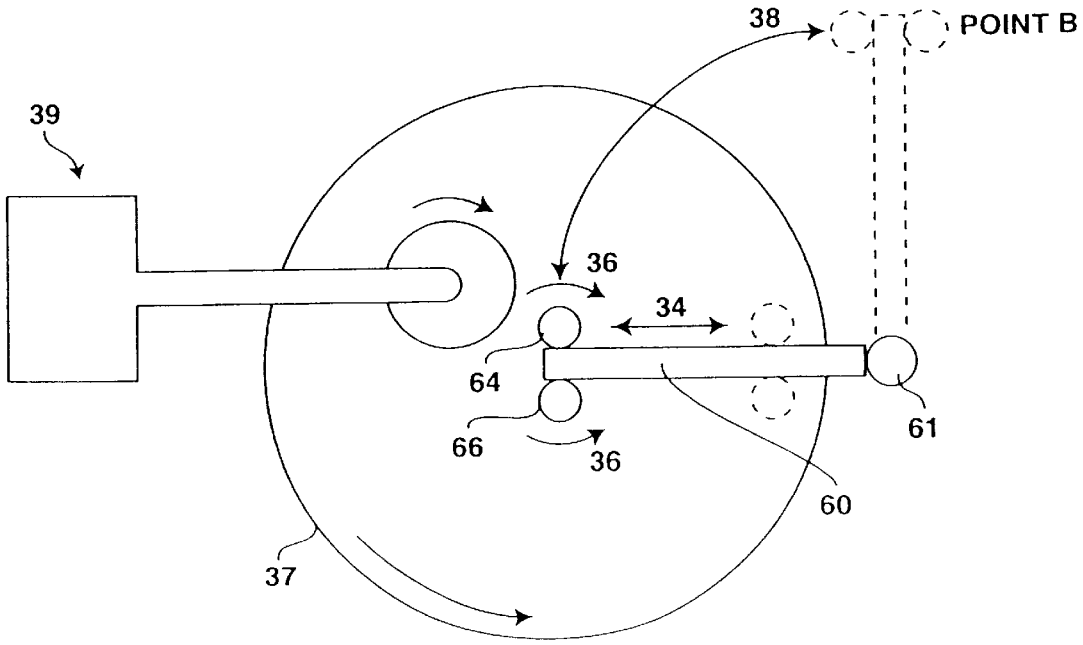
FIG. 4C illustrates a top view of the conditioning device of FIG. 4A as used with an orbital polishing tool.
Figure 4B:
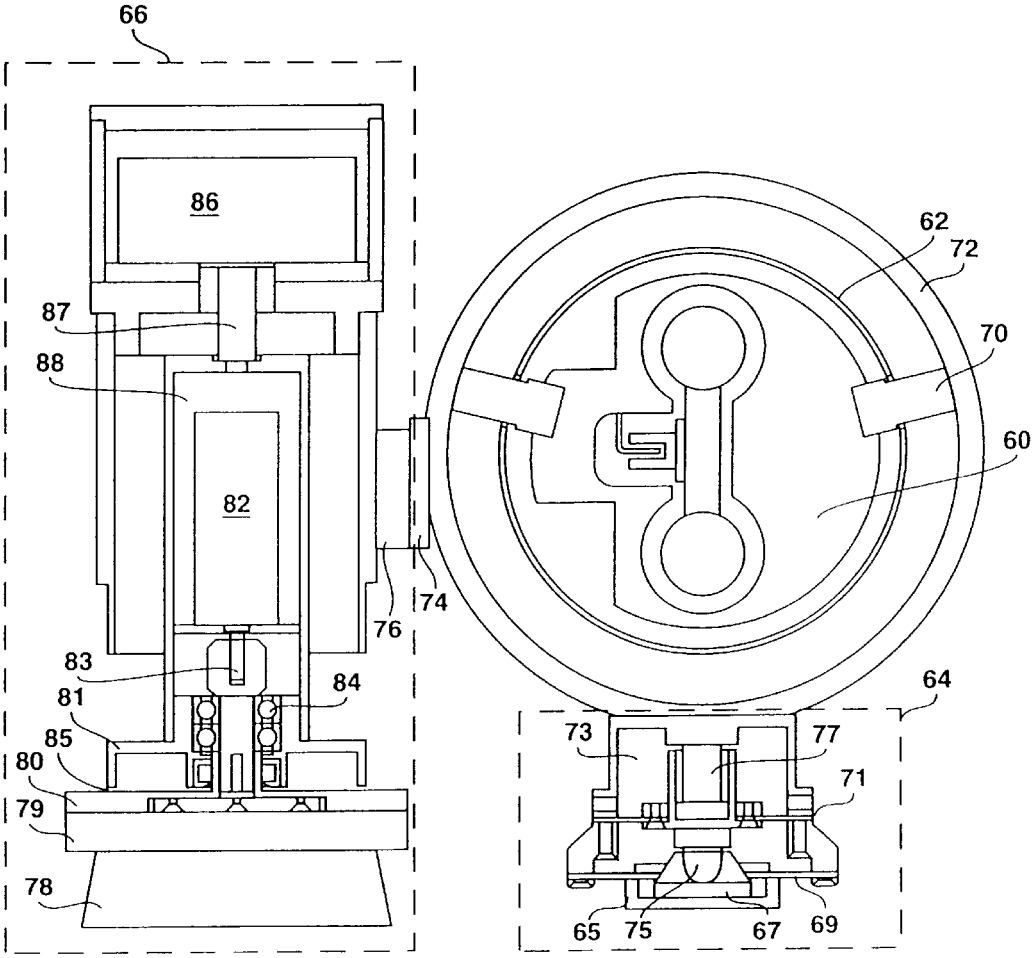
FIG. 4B illustrates a side view of the conditioning device of FIG. 4A.

FIG. 4C shows a top view of the third embodiment of a conditioning device of the present invention as used with an orbital polishing tool 39, such as the one shown in FIG. 1B. The conditioning apparatus, comprising the conditioning arm 60 and end effectors 64 and 66, begins in a home position at point B to the side of the polishing tool and pivots about path 38 until it is in a spaced relation parallel to the polishing pad 37. The end effectors 64 and 66 move linearly 34 along the conditioning arm 60 and may also independently rotate 36 about a vertical axis normal to the surface of the polishing pad. In addition to the movement of the end effectors, the conditioning arm 60 may sweep along path 38 during the conditioning process to further condition the polishing pad 37 from the center of the pad to its outside edge, depending on the relative size of the polishing pad, the wafer being polished, and the end effectors. The angular movement of the conditioning arm 60 can be achieved using a motor, rotary pneumatic actuator or other such means that would typically be housed within the base 61.

Figure 5A:
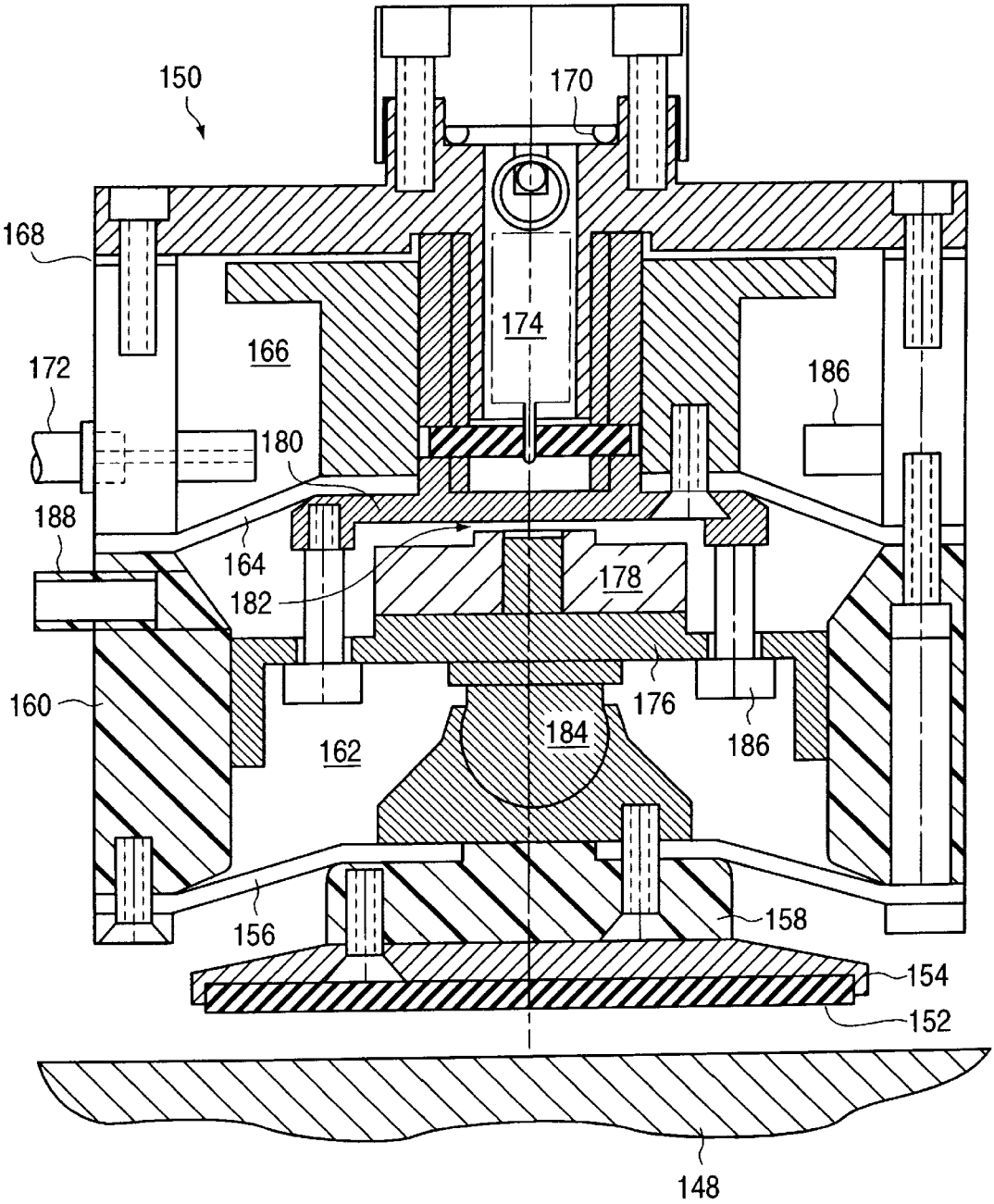
FIG. 5A illustrates a side view of the conditioning device of the present invention in the retracted (home) position.
Figure 5B:
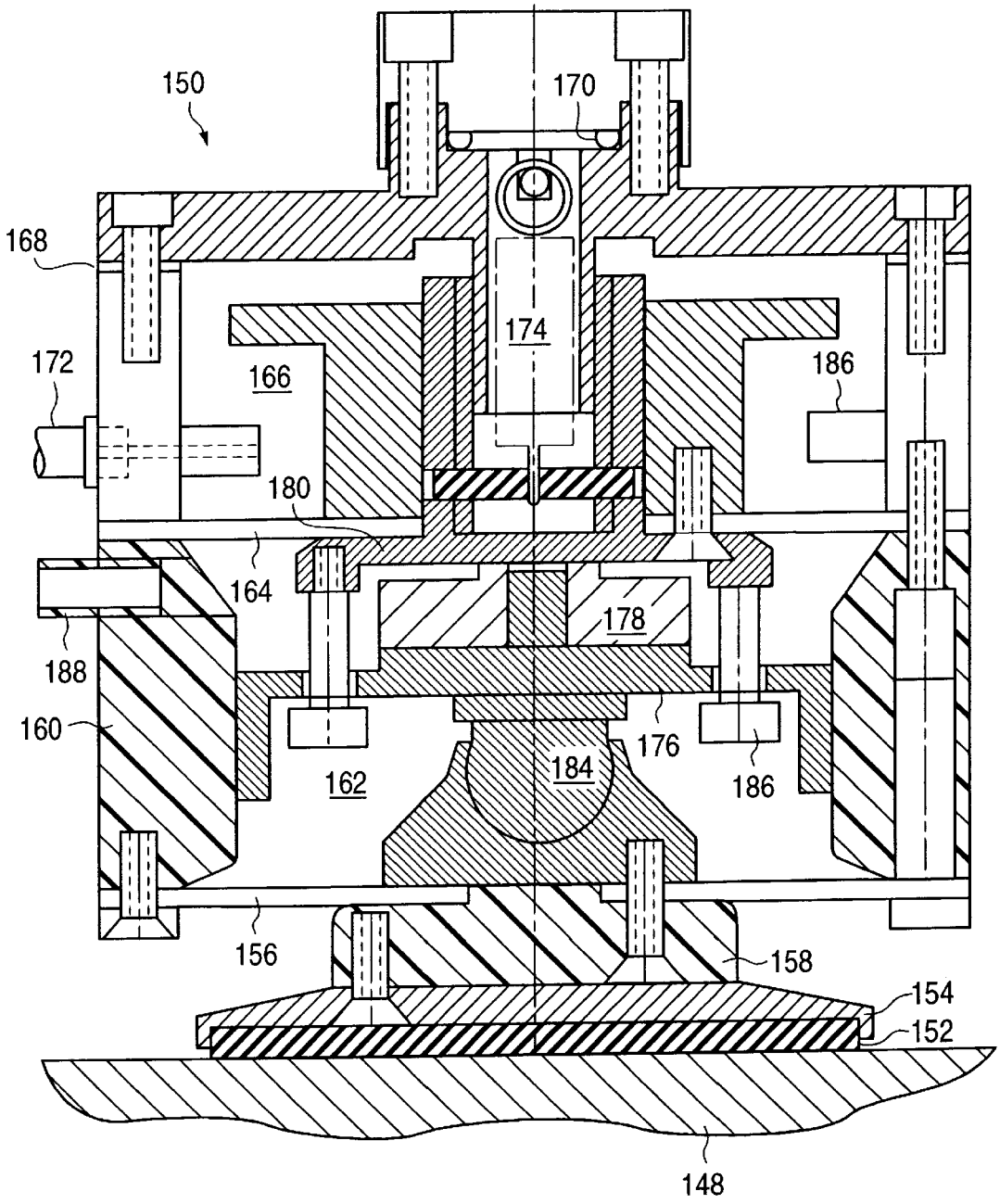
FIG. 5B illustrates a side view of the conditioning device of FIG. 5A in the extended (working) position.

An alternative embodiment to an end effector having a hard element (e.g., diamond bits, serrated steel bits, ceramic bits, or stiff synthetic fibers) attached to its bottom surface, such as end effectors 44 (see FIG. 2B), 90 (see FIG. 3B), and 64 (see FIG. 4B) described above, is illustrated in FIGS. 5A and 5B. FIG. 5A is a side cross-sectional view of an end effector 150 in the retracted (or home, at rest) position. FIG. 5B is a side cross-sectional view of the same end effector 150 in the extended (or working) position. End effector 150 operates functionally in a similar manner to end effectors 90 (see FIG. 3B) and 64 (see FIG. 4B), with the added capability of sensing the amount of load the end effector 150 is under.

FIG. 5A illustrates the end effector 150 in the retracted (or home, at rest) position. As with end effectors 90 (see FIG. 3B) and 64 (see FIG. 4B), end effector 150 is used for abrasive conditioning. The face (or conditioning surface) 152 comprises hard particles, such as diamond particles, and fits inside a magnetic holder 154 (note that other methods of coupling the face 152 to the end effector 150 may also be used). The holder 154 couples to a diaphragm 156 by a spacer (or connecting piece) 158. The diaphragm 156 couples to the outer housing 160 and isolates the inside of end effector 150 from slurry and polishing byproducts. Lower chamber 162 is then sealed by a second diaphragm 164. Upper chamber 166 is sealed by the second diaphragm 164, gasket 168, and o-ring 170. Compressed air is released into the upper chamber 166 through fitting 172 by a regulator and valve to create a downward force acting against the spring 174 that retains the face 152 in the retracted position. As the pressure within the upper chamber 166 increases, the spring 174 begins to extend and bushing 176 with attached sensor 178 is allowed to fall down under its own weight into contact with the polishing pad 148, as shown in FIG. 5B.

When the face (or diamond disk) 152 comes into contact with the polishing pad 148, the small gap 182 between the sensor 178 and bushing 180 disappears. Bushing 180 pushes onto the sensor 178 and through the gimbal mechanism (e.g., a ball and socket) 184, spacer 158, and face 152, the bushing 180 also pushes onto the polishing pad 148. Stops 186 located in the upper chamber 166 limit the downward travel of the diaphragm 164 when compressed air is delivered to the upper chamber 166 and the polishing pad 148 (or table/belt combination) is not present.

Once the air pressure is released (or removed) from the upper chamber 166, the spring 174 retracts, disengaging the bushing 180 from the load cell 178 and lifting bushing 176 by shoulder screws 186. In this retracted position, a gap 182 of approximately 0.02 in. exists between the bushing 180 and the sensor 178. At this point (i.e., when the gap exists), the sensor 178 is not in contact with bushing 180 and reads "0" if properly calibrated.

A wire (not shown) is coupled to the sensor 178 and passes through fitting 188 to connect with the operating system for the end effector 150. (Note that in one embodiment the sensor 178 is a the load cell, such as a Model D donut shaped cell from Sensotec.) In this manner, the sensor 178 provides a reading not affected by the return spring 174, which represents the true load or reaction force from the polishing pad 148 to the compressed air in the upper chamber 166. Such a reading allows modifications to the pressure of compressed air delivered to upper chamber 166 to be made as necessary. Note that any side load generated by the motion of the polishing pad 148 relative to the face 152 of end effector 150 is compensated for by the bushing 176, which has a close tolerance (i.e., slide fit) to the outer housing 160, and should not affect the readings of sensor 178.

The sensor 178 coupled with an automatic air pressure regulator provides closed loop load control of the end effector 150 onto the polishing pad 148. Such closed loop load control allows software selectable loads, compensation for regulator calibration errors, and allows controlled pressure profiling of the polishing pad 148. With controlled pressure profiling, the end effector 150 may remove more or less pad material by applying higher or lower pressure to the face 152 as a function of distance from the edge of the polishing pad 148.

Figure 6A:
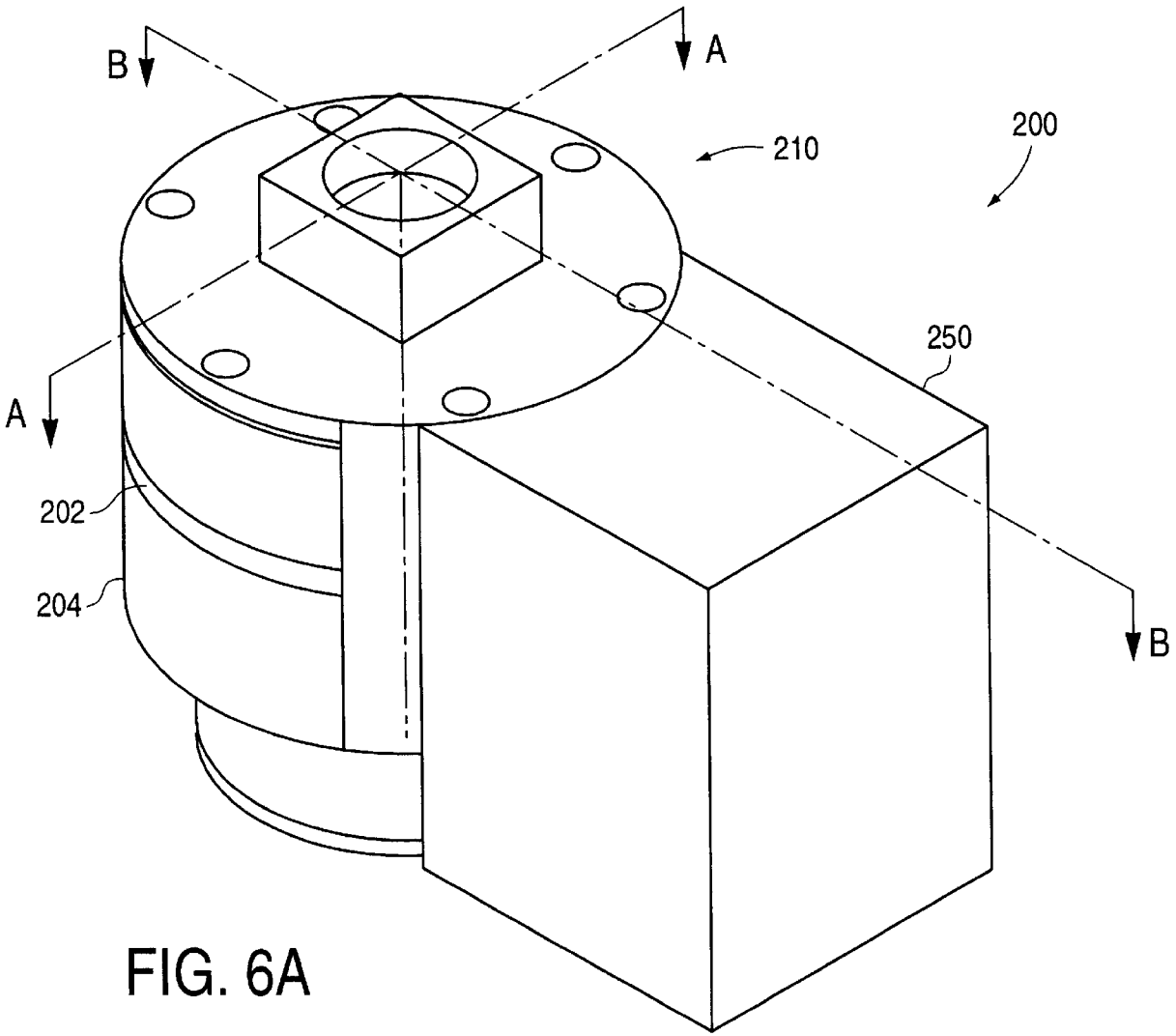
FIG. 6A illustrates an embodiment of a conditioning device of the present invention.
Figure 6B:
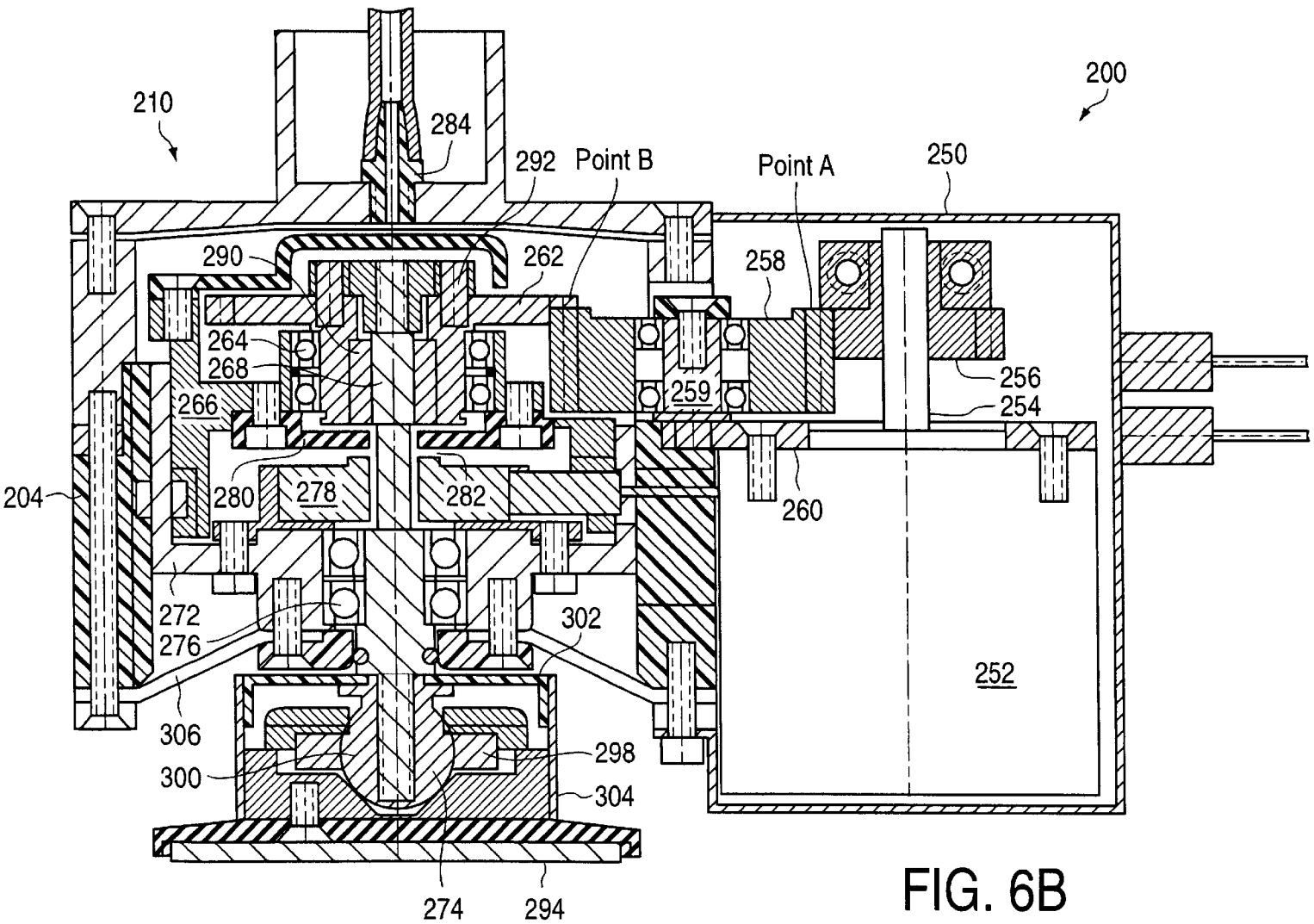
FIG. 6B illustrates a side cross-sectional view of the conditioning device of FIG. 6A (Section B—B) when in the retracted (home) position.
Figure 6C:
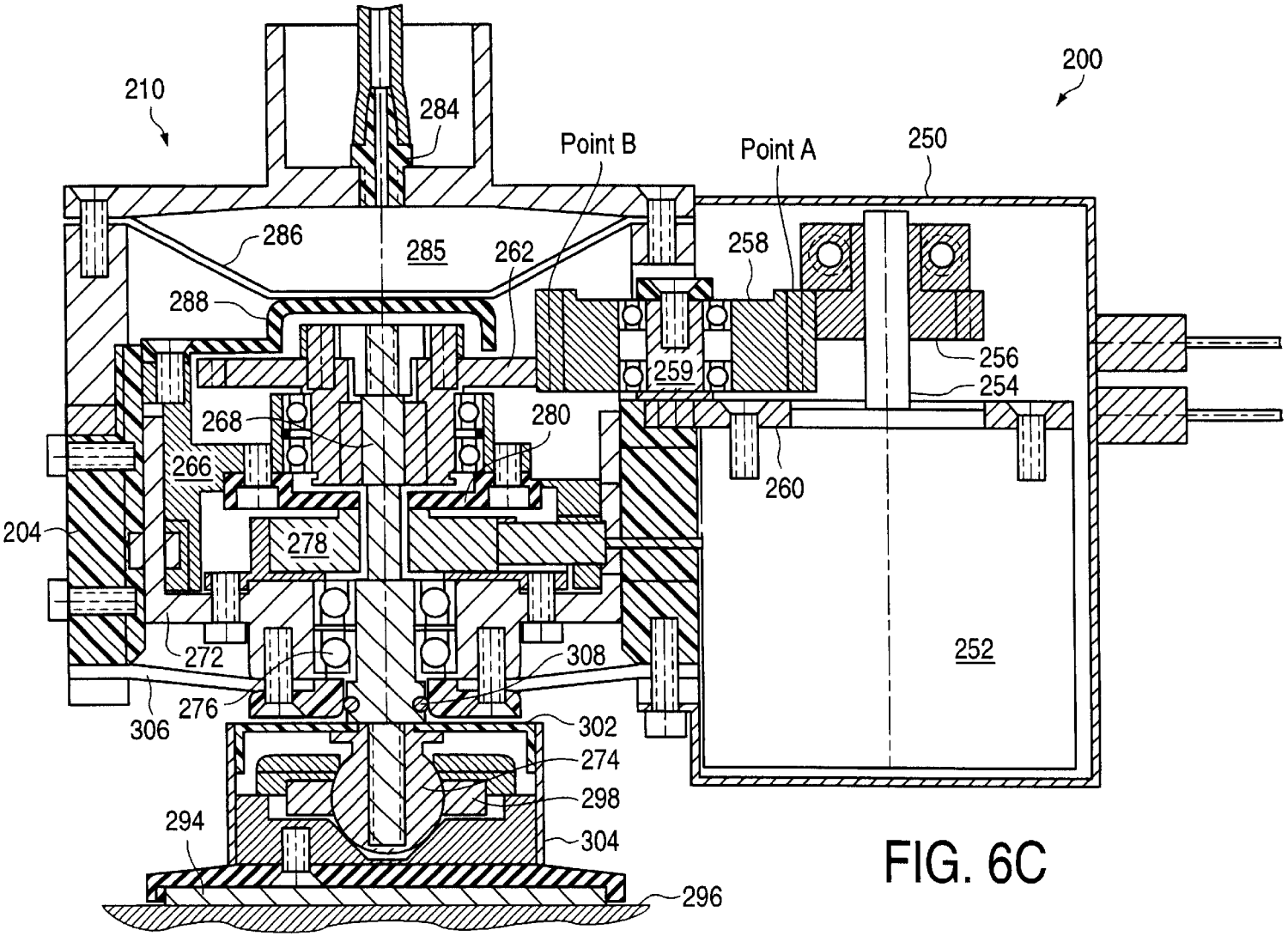
FIG. 6C illustrates a side cross-sectional device of FIG. 6A (Section B—B) when in the extended (working) position.
Figure 6D:
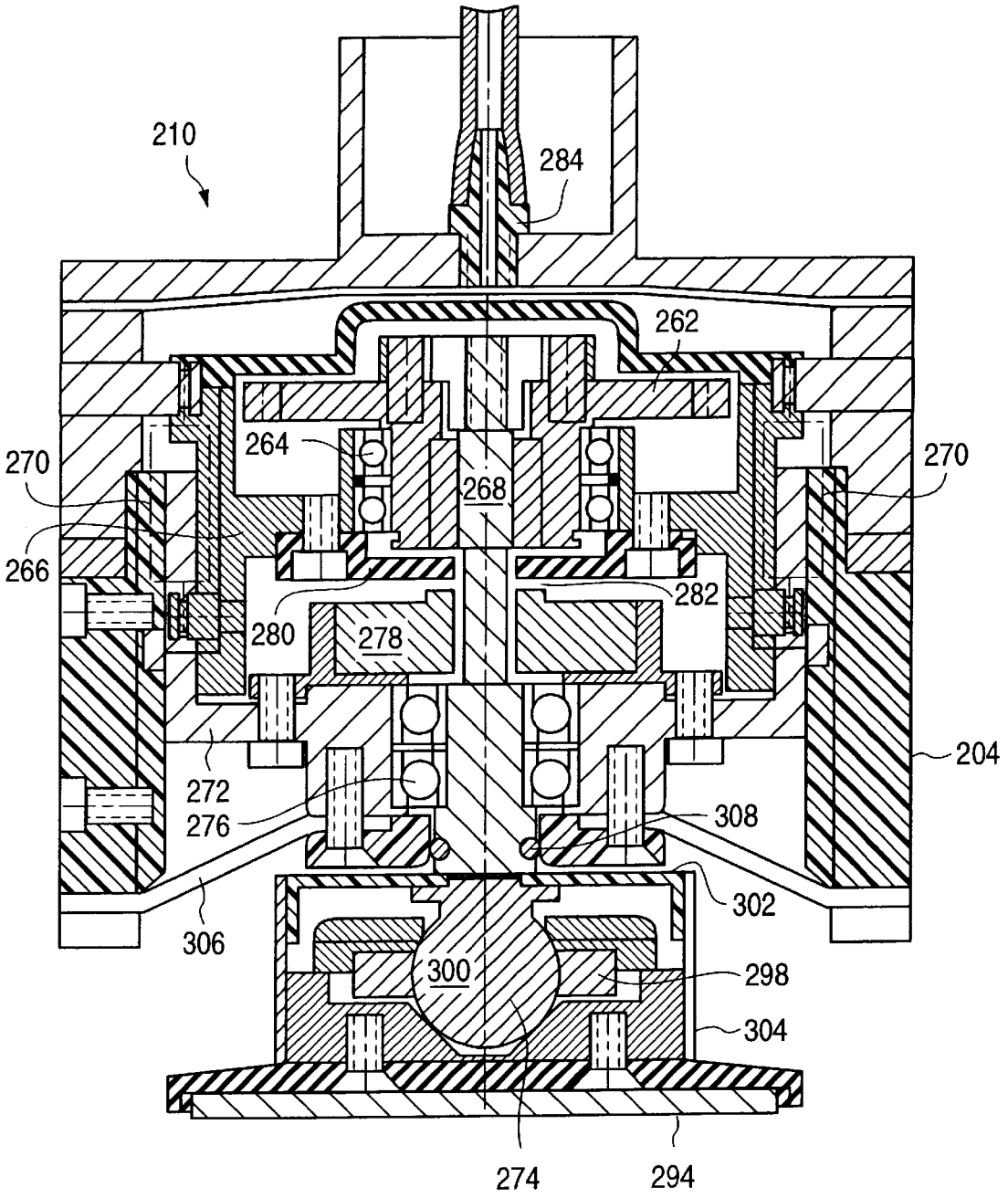
FIG. 6D illustrates a side cross-sectional view of the end effector of the conditioning device of FIG. 6A (Section A—A) when in the retracted (home) position.

A second alternative embodiment to an end effector having a hard element (e.g., diamond bits, serrated steel bits, ceramic bits, or stiff synthetic fibers) attached to its bottom surface, such as end effectors 44 (see FIG. 2B), 90 (see FIG. 3B), and 64 (see FIG. 4B) described above, is illustrated in FIGS. 6A, 6B, 6C, and 6D. FIG. 6A provides a pictorial illustration of a conditioning device 200 of the present invention, including an end effector 210 coupled to a motor housing 250. FIG. 6B is a side cross-sectional view of the conditioning device 200 of FIG. 6A (Section B—B) when the end effector 210 is in the retracted (or home, at rest, upper) position. FIG. 6C is a side cross-sectional view of the conditioning device 200 of FIG. 6A (Section B—B) when the end effector 210 is in the extended (working) position. FIG. 6D is a side cross-sectional view of the condition device 200 of FIG. 6A (Section A—A), showing merely the end effector 210 in the retracted position. End effector 210 operates functionally in a similar manner to end effector 150 (see FIGS. 5A and 5B), with the added capability of an independently rotating conditioning surface (i.e., face or diamond disk).

FIG. 6A illustrates the conditioning device 200 of the present invention, including an end effector 210 coupled to a motor housing 250. A motor (not shown) housed within the casing 250 provides rotational movement to the central shaft of end effector 210. The end effector outer casing 204 is coupled to the motor housing 250, for example via screws (not shown). Note that in this embodiment, the whole end effector 210 as well as the motor and motor housing 250 do not rotate. Instead, it is the central shaft 268 that allows the conditioning face 294 of the end effector 210 to rotate and gimbal.

FIG. 6B is a side cross-sectional view of the conditioning device 200 of FIG. 6A (Section B—B) when the end effector 210 is in the retracted (or home, at rest, upper) position. In this embodiment, a motor 252 coupled to bracket 260 and housed in casing 250 provides the rotational movement of the central shaft 268 of the end effector 210 through a series of gears. The motor 252 provides rotational motion to the motor shaft 254. Mounted on the motor shaft 254 is gear 256. Gear 256 then interacts at Point A with gear 258, which is mounted about shaft 259 extending from the supporting plate 260. Gear 258 interacts at Point B with gear 262, which is mounted about the main shaft 268. Two bearings 264 held in by bushing 266 press onto gear 262. The torque from the motor is thus transferred to the end effector's main shaft 268. In one embodiment, a size 17 stepper motor with a 62 oz-in continuous torque is used. The selection of the gears will depend on the particular design limitations of a given application. In one embodiment, the selection of the gears increases the applied torque by a factor of two to provide approximately 120 oz-in of torque on the main shaft 268. Note also that a motor or other means of delivering rotation may be located external to the conditioning device 200 and then coupled to gear 258.

As with end effector 150, the force of the springs (see 270 in FIG. 6D) pulls up housing 272 and main shaft 268 with the gimbaled assembly 274 through bearings 276. Note that in the retracted position, shown in both FIGS. 6B and 6D, the retainer 280 does not contact the sensor 278, but instead leaves a gap 282 of approximately 0.02 in. Thus, the sensor reads "0" in the retracted position when calibrated correctly. When the air pressure is relieved, springs 270 pull the bushing 266 up, disengaging the sensor 278 and allowing the main shaft 268 to pull the inner housing 272 up. At this point, there is again a gap 282 between the retainer 280 and the sensor 278, and the sensor 278 once again reads "0".

FIG. 6C is a side cross-sectional view of the conditioning device 200 of FIG. 6A (Section B—B) when the end effector 210 is in the extended (working) position. Delivery of compressed air through the fitting 284 into the upper chamber 285 extends the diaphragm 286 and applies pressure to the spacer 288, which is attached to the bushing 266. Bushing 266 slides down inside the housing 270, allowing the housing 270 and the whole lower assembly, including sensor 278, to slide down inside the outer housing 204. Due to the slight friction between the inner housing 272 and the outer housing 204, a slight load may be imposed on the sensor 278 (typically less than 0.5 lbs.). The sensor 278 may be calibrated such that load due to friction is not reflected in the sensor 278 readings.

The air pressure in upper chamber 285 presses the whole inner assembly down until the face (or diamond disk) 294 makes contact with the polishing pad 296. At this point, the retainer 280 pushes on the load cell 278, which then reads the true load reading (or the reaction force). The gimbaled assembly 274 rotates via a pin 298 pressed into a ball 300. The gimbaled assembly 274 is protected from the slurry and polishing by products by the upper shield 302 and the flexible (e.g., rubber) sleeve 304. The inner assembly of the end effector 210 is protected from the slurry and by products by the diaphragm 306 and o-ring 308.

During delivery of compressed air to upper chamber 285, the gap 282 between the retainer 280 and the sensor 278 disappears as the main shaft 268 is allowed to slide up the same distance in the bushing 290, which lines the gear 262. The main shaft 268 retains the coupling with the gear 262 by the two pins 292 pressed into the gear 262. Likewise, gear 262 slides down to the working position while retaining contact with the gear 258, allowing rotation of the main shaft 268 and gimbaled assembly 274 at all times. The rotation may start prior to or after the contact with the polishing pad 296 has been made.

The end effectors 150 and 210 with sensors 178 and 278 provide several advantages over the previously described end effectors. First, the end effectors provide true reaction force readings that do not require compensation or adjustment of any kind. Second, the end effectors provide planarization of the polishing pad better than similar devices without a return spring. For example, if there is a depression in the polishing pad, the face will move down only slightly because the spring extension requires additional force from the diaphragm. Further, high (raised) areas on the polishing pad will see higher than normal pressure, with a constant air pressure supplied to the upper chamber, since less air pressure is required to overcome the spring.

As discussed in the above embodiments, different types of end effectors may be used to achieve different types of conditioning characteristics. Other means than those detailed above are also available. For example, an end effector directing a stream of air, water, or some other agent at the polishing pad could be used to remove imbedded slurry and polishing byproducts. The force of the fluid and the amount of fluid directed at the polishing pad could be varied to achieve a variety of conditioning characteristics.

The present invention's use of multiple end effectors with different properties provides many advantages over the prior art. With the practice of the present invention, whether on a linear or an orbital polisher, each end effector can be independently controlled with respect to when it is lowered or otherwise brought into contact with the polishing pad, the amount of force it applies to the polishing pad once in contact with the pad, and the movement (both linear and angular) it makes while in contact with the polishing pad.

One advantage of the present invention is its ability to recondition pads of different types without requiring the end effectors to be replaced each time a different type of pad is used. Accordingly, providing a plurality of conditioning elements, by way of end effectors, allows the polishing process to not be interrupted when different conditioning characteristics are needed. It also reduces the downtime of the tool when more than one conditioning element is required.

The present invention also addresses the need for complex conditioning of a pad and the conditioning of different pad types by placing two or more end effectors with different properties on the same pad conditioning mechanism. The present invention allows one or more end effectors of the appropriate material, depending on the properties of the polishing pad, to come into contact with the surface of the polishing pad and recondition the surface of the pad. Thus, when using a hard polishing pad, the hard end effector lowers to recondition the polishing pad. Likewise, when using a softer polishing pad, the softer end effector lowers to recondition the polishing pad.

By allowing multiple end effectors to independently work under different process conditions, the present invention provides another method of allowing the same conditioning apparatus to be used to condition pads of different properties. For example, the force being applied by one end effector onto the polishing pad may be significantly higher than the force applied by another end effector to the pad's surface. In this manner, a different degree of abrasion could by created depending on the characteristics of the polishing pad and the amount of force applied. Thus, multiple polishing pads with different properties may be reconditioned without switching out the end effectors. Furthermore, with proper monitoring and control, in-situ adjustments could be made to vary the conditioning characteristics or profile before, during, or after performing CMP.

In addition, the presence of two or more end effectors with different properties on the same pad conditioning mechanism allows the polishing byproducts to be loosened by a hard end effector and then brushed or washed away by a second softer end effector. This is an improvement over the current technique of abrading the surface and assuming the slurry added during the polishing process would flush the reconditioned area and wash away any loosened material.

Thus, a conditioning mechanism employing a plurality of end effectors and in which at least two different conditioning medium or materials are utilized with the end effectors to condition the polishing pad is described.

We claim:

1. An apparatus for conditioning a polishing pad, comprising:

a conditioning surface; and a sensor coupled to said conditioning surface, said sensor for detecting an amount of a first force exerted by said conditioning surface against said polishing pad;

wherein said sensor is coupled to a retainer when said conditioning surface is in contact with said polishing pad, and said sensor is decoupled from said retainer when said conditioning surface is not is contact with said polishing pad.

2. The apparatus of claim 1 wherein said sensor is a load cell.

3. The apparatus of claim 1, wherein said sensor is calibrated to read zero when said sensor is decoupled from said retainer.

4. The apparatus of claim 1, wherein an amount of a second force exerted between said retainer and said sensor is approximately the same as the amount of the first force when said conditioning surface is in contact with said polishing pad.

5. The apparatus of claim 4 wherein said sealed chamber is expandable such that when filled with compressed air said sealed chamber lowers said conditioning surface.

6. The apparatus of claim 4 further comprising a spring coupled to said conditioning surface, said spring raising said conditioning surface.

7. The apparatus of claim 1 wherein said conditioning surface is comprised of an abrasive material.

8. The apparatus of claim 7 wherein said abrasive material is comprised of diamond bits, steel bits, or ceramic bits.

9. The apparatus of claim 1 wherein said conditioning surface rotates about an axis normal to said polishing pad.

10. The apparatus of claim 9 further comprising a motor for rotating said conditioning surface.

11. The apparatus of claim 1 wherein said first conditioning material is comprised of a hardened abrasive material.

12. The apparatus of claim 11 wherein said first conditioning material is comprised of diamond bits, steel bits or ceramic bits.

13. The apparatus of claim 12 wherein said second conditioning material is comprised of synthetic fibers.

14. An apparatus for conditioning a surface of a polishing pad, comprising:

a first conditioner having a first conditioning material;

a second conditioner coupled to said first conditioner and having a second conditioning material which is different from said first conditioning material; and, a load sensor coupled to said first conditioner.

15. The apparatus of claim 14 wherein said load sensor is for detecting the amount of force exerted against said conditioning surface.

16. An apparatus for conditioning a surface of a polishing pad utilized for polishing a surface, comprising:

a support arm;

a first conditioner coupled to said support arm and having a first conditioning material resident thereon for providing a first conditioning characteristic when conditioning said polishing pad;

a second conditioner coupled to said support arm and having a second conditioning material resident thereon for providing a second conditioning characteristic when conditioning said polishing pad; and, a sensor coupled to said first conditioner, said sensor for detecting the amount of force exerted against said first conditioner.

17. The apparatus of claim 16 wherein at least one of said first and second conditioners rotates about a vertical axis normal to said polishing pad to condition said polishing pad.

18. The apparatus of claim 16 wherein said first and second conditioners engage said polishing pad by an exertion of different amounts of force against said polishing pad.

19. The apparatus of claim 16 wherein said first conditioning material is comprised of an abrasive material.

20. The apparatus of claim 16 wherein said first conditioning material is comprised of diamond bits, steel bits or ceramic bits.

21. The apparatus of claim 20 wherein said second conditioning material is comprised of synthetic fibers.

22. A method of conditioning a surface of a polishing pad, comprising:

bringing a conditioner into contact with the surface of the polishing pad;

bringing a sensor into contact with a retainer when said conditioner is brought into contact with the surface of the polishing pad;

conditioning the surface of the polishing pad with said conditioner;

sensing an amount of force exerted on said polishing pad by said conditioner by sensing an amount of force exerted on said sensor by said retainer.

23. The method of claim 22 wherein said conditioning step further comprises rotating said conditioner about an axis normal to the polishing pad.

24. The method of claim 22 wherein said step of lowering a conditioner further comprises lowering a conditioner comprising an abrasive material into contact with the surface of the polishing pad.

25. The method of claim 22 wherein said sensing step further comprises sensing the amount of force exerted on said conditioner by the polishing pad with a sensor coupled to the polishing pad.

* * * * *